US009303218B2

(12) United States Patent
Ellis et al.

(10) Patent No.: US 9,303,218 B2
(45) Date of Patent: Apr. 5, 2016

(54) STACKING OF LOW ACTIVITY OR REGENERATED CATALYST ABOVE HIGHER ACTIVITY CATALYST

(75) Inventors: Edward S. Ellis, Basking Ridge, NJ (US); Rohit Vijay, Annandale, NJ (US); Matthew Bennett, Southampton (GB)

(73) Assignee: ExxonMobil Research and Engineering Company, Annandale, NJ (US)

( * ) Notice: Subject to any disclaimer, the term of this patent is extended or adjusted under 35 U.S.C. 154(b) by 854 days.

(21) Appl. No.: 12/889,604

(22) Filed: Sep. 24, 2010

(65) Prior Publication Data

US 2011/0079542 A1 Apr. 7, 2011

Related U.S. Application Data

(60) Provisional application No. 61/278,245, filed on Oct. 5, 2009.

(51) Int. Cl.
*C10G 45/08* (2006.01)
*C10G 65/04* (2006.01)

(52) U.S. Cl.
CPC ..... *C10G 65/04* (2013.01); *C10G 45/08* (2013.01); *C10G 2300/1055* (2013.01); *C10G 2300/202* (2013.01); *C10G 2300/301* (2013.01); *C10G 2300/4018* (2013.01)

(58) Field of Classification Search
CPC ..... C10G 45/04; C10G 45/08; C10G 65/02; C10G 65/04; C10G 2300/301; C10G 2300/1055; C10G 2300/202; C10G 2300/4018
USPC ..... 208/210, 89; 585/737
See application file for complete search history.

(56) References Cited

U.S. PATENT DOCUMENTS

| | | | | |
|---|---|---|---|---|
| 3,714,030 | A * | 1/1973 | Winsor et al. | 208/210 |
| 4,827,076 | A * | 5/1989 | Kokayeff et al. | 585/737 |
| 5,503,734 | A * | 4/1996 | Fletcher et al. | 208/89 |
| 5,925,238 | A * | 7/1999 | Duddy et al. | 208/210 |
| 6,156,695 | A | 12/2000 | Soled et al. | |
| 6,162,350 | A | 12/2000 | Soled et al. | |
| 6,299,760 | B1 | 10/2001 | Soled et al. | |
| 6,582,590 | B1 | 6/2003 | Riley et al. | |
| 6,712,955 | B1 | 3/2004 | Hou et al. | |
| 6,783,663 | B1 | 8/2004 | Riley et al. | |
| 6,863,803 | B1 | 3/2005 | Riley et al. | |
| 6,929,738 | B1 | 8/2005 | Riley et al. | |
| 7,229,548 | B2 | 6/2007 | Riley et al. | |
| 7,288,182 | B1 | 10/2007 | Soled et al. | |
| 7,410,924 | B2 | 8/2008 | Corma Canos et al. | |
| 7,435,335 | B1 | 10/2008 | Ellis et al. | |
| 7,544,632 | B2 | 6/2009 | Soled et al. | |
| 2003/0070965 | A1 * | 4/2003 | Shih et al. | 208/210 |
| 2005/0277545 | A1 | 12/2005 | Shih et al. | |
| 2006/0060502 | A1 | 3/2006 | Soled et al. | |
| 2007/0084754 | A1 | 4/2007 | Soled et al. | |
| 2008/0132407 | A1 | 6/2008 | Bai et al. | |

FOREIGN PATENT DOCUMENTS

| | | | |
|---|---|---|---|
| JP | 1999335677 | A | 12/1999 |
| JP | 2000017274 | A | 1/2000 |
| JP | 2004148139 | A | 5/2004 |
| JP | 2009183891 | A | 8/2009 |
| JP | 2009202119 | A | 9/2009 |
| WO | 2004/007646 | A1 | 1/2004 |
| WO | 2007/084437 | A2 | 7/2007 |
| WO | 2007/084438 | A2 | 7/2007 |
| WO | 2007/084439 | A1 | 7/2007 |
| WO | 2007/084471 | A1 | 7/2007 |
| WO | 2008016971 | | 2/2008 |

OTHER PUBLICATIONS

Ken Robinson, "Reactor Engineering," Encyclopedia of Chemical Processing 2557, 2567-68 (2006).*

Sie, S.T. and Krishna, R., "Process Development and Scale Up: III. Scale-up and scale-down of trickle bed processes," Reviews in Chemical Engineering 14, 3, p. 203, 213 (1998).*

* cited by examiner

*Primary Examiner* — Prem C Singh
*Assistant Examiner* — Brandi M Doyle
(74) *Attorney, Agent, or Firm* — Chad A. Guice; David M. Weisberg; Bruce M. Bordelon

(57) ABSTRACT

Processes are provided for using employing lower activity hydrodesulfurization catalysts while achieving a desired product sulfur content. After determining effective reaction conditions for hydrodesulfurization using a reference catalyst system, an upstream portion of the catalyst system can be replaced with a lower activity upstream portion. The process allows tailored product sulfur levels to be achieved using reaction conditions similar to those for the reference catalyst system.

16 Claims, 6 Drawing Sheets

STACKING OF LOW ACTIVITY OR REGENERATED CATALYST ABOVE HIGHER ACTIVITY CATALYST

This Application claims the benefit of U.S. Application No. 61/278,245, filed Oct. 5, 2009.

FIELD OF THE INVENTION

Embodiments of the invention are generally related to hydroprocessing of distillate feeds to produce low sulfur products.

BACKGROUND OF THE INVENTION

Sulfur requirements for many products based on distillate feeds have become stricter in recent years. For example, many countries are moving to requirements for sulfur levels of 20 wppm or less, or even 10 wppm or less, for diesel fuels. Various catalysts and reaction conditions are available for achieving these more stringent sulfur requirements. However, the state-of-the-art catalysts that provide the best performance can be quite costly.

SUMMARY OF THE INVENTION

In an embodiment, a method for treating a distillate feed with a plurality of hydrodesulfurization catalysts is provided. The method includes determining effective reaction conditions for processing a distillate feed with a first catalyst, including a temperature, a pressure, a ratio of hydrogen treat gas volume to feed volume, and a liquid hourly space velocity. The effective reaction conditions are suitable to form a distillate product having a target sulfur content of about 100 wppm of sulfur or less. A first volume of the first catalyst is then provided. A second volume of a second catalyst is also provided, the first volume and second volume comprising a combined volume. The second catalyst has a hydrodesulfurization activity that is from about 75% to about 90% of a hydrodesulfurization activity of the first catalyst. The first volume corresponds to from about 50% to about 90% of the combined volume. The distillate feed is then processed under second reaction conditions that are substantially similar to the temperature, the pressure, the ratio of treat gas rate volume to feed volume, and the liquid hourly space velocity of the effective reaction conditions. During processing, the distillate feed contacts the second volume of catalyst prior to the first volume of catalyst. The processing produces a distillate product having a sulfur content within 10 wppm of the target sulfur content.

In another embodiment, a method is provided for treating a distillate feed with a plurality of hydrodesulfurization catalysts. The method includes determining effective reaction conditions for processing a distillate feed with a first catalyst system, including a temperature, a pressure, a ratio of hydrogen treat gas volume to feed volume, and a liquid hourly space velocity. The effective reaction conditions are suitable to form a distillate product having a target sulfur content of about 100 wppm of sulfur or less. The first catalyst system includes an upstream volume portion and a downstream volume portion, the downstream volume being about 50% to about 90% of a combined volume of the upstream volume and downstream volume. The downstream volume portion of the first catalyst system is then provided. A second catalyst system is also provided. The second catalyst system has a hydrodesulfurization activity that is from about 75% to about 90% of a hydrodesulfurization activity of the upstream volume portion of the first catalyst system. The distillate feed in the reaction system is then processed under second reaction conditions that are substantially similar to the temperature, the pressure, the ratio of treat gas rate volume to feed volume, and the liquid hourly space velocity of the effective reaction conditions. The distillate feed contacts the second catalyst system prior to contacting the first downstream volume portion of the first catalyst system. A distillate product is produced having a sulfur content within 10 wppm of the target sulfur content.

In yet another embodiment, a method for treating a distillate feed with a plurality of hydrodesulfurization catalysts is provided. The method includes determining effective reaction conditions for processing a distillate feed with an effective volume of a first catalyst system. The effective reaction conditions include a temperature, a pressure, and a treat gas ratio. The effective reaction conditions are suitable to form a distillate product having a sulfur content of about 50 wppm of sulfur or less. The first catalyst system includes an upstream volume portion and a downstream volume portion. The downstream volume portion of the first catalyst system has a volume that is about 50% to about 90% of a combined volume of the upstream volume and downstream volume. The downstream volume portion of the first catalyst system is then provided. A second catalyst system is also provided that has a hydrodesulfurization activity that is from about 75% to about 90% of a hydrodesulfurization activity of the upstream volume portion of the first catalyst system. The second catalyst system has a volume that is about 105% or less of the upstream volume. The distillate feed is then processed under second reaction conditions that are substantially similar to the temperature, the pressure, the ratio of treat gas rate volume to feed volume, and the liquid hourly space velocity of the effective reaction conditions. A distillate product is produced having a sulfur content of about 50 wppm or less.

DETAILED DESCRIPTION OF THE EMBODIMENTS

Overview

Figure 1:
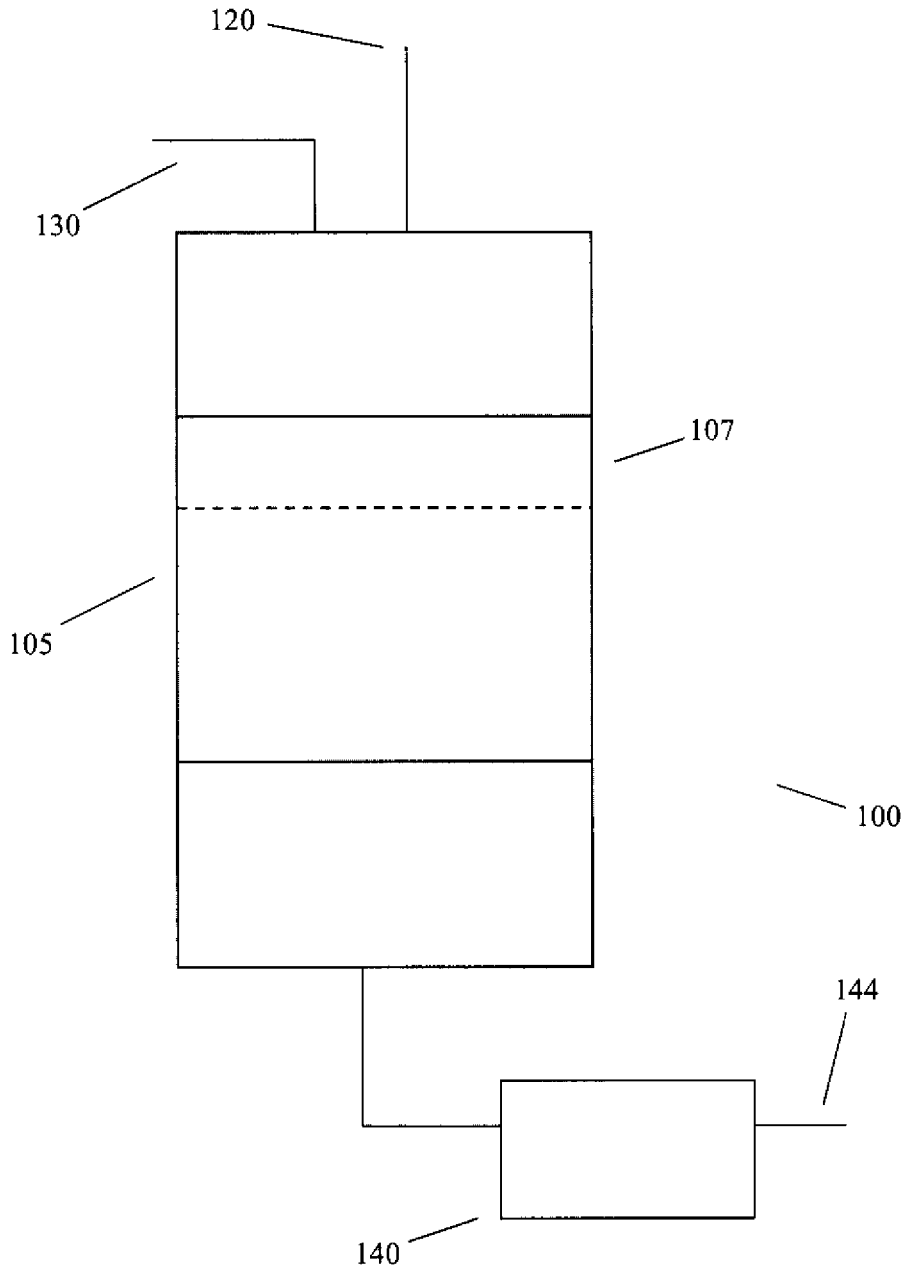
FIG. 1 schematically shows a reaction system for performing a process according to an embodiment of the invention.

In various embodiments, a process is provided for producing a distillate product with reduced sulfur content at a lower cost as compared to conventional processes. It has been discovered that catalysts considered to be "lower activity" catalysts can have a similar ability remove sulfur as compared to "higher activity" catalysts for desulfurization to sulfur levels of about 400 wppm sulfur to about 1500 wppm sulfur. More generally, a catalyst system considered to have a lower activity can have a similar ability to remove sulfur as a higher activity catalyst system for removal of sulfur in the range of about 400 wppm to 1500 wppm. While the catalysts/systems discussed herein may have similar ability for desulfurization down to the ~400-1500 wppm range, it should be understood that these catalysts/systems may additionally or alternately be used to desulfurize feedstreams to form distillate product with sulfur contents of about 100 wppm or less (e.g., about 50 wppm or less, about 30 wppm or less, about 15 wppm or less, or even about 10 wppm or less), or with sulfur contents above about 1500 wppm (e.g., about 2000 wppm or more, about 3000 wppm or more, about 4000 wppm or more, about 5000 wppm or more, or even about 6000 wppm or more). In the discussion below, a catalyst system is defined as one or more catalysts. Thus, use of a single catalyst in a reactor corresponds to a catalyst system in that reactor including only one catalyst.

Conventionally, a higher activity catalyst system can provide a variety of advantages for a reaction system. One advantage can be enabling a lower sulfur target to be achieved for a given combination of feed properties and reaction conditions. Another potential advantage can be the ability to increase the space velocity for a reactor, as a higher activity catalyst system can process a larger amount of feed per volume of catalyst while producing a similar product. Rather than increasing the flow of feed through a reaction system, the space velocity can also be increased by reducing the amount of catalyst used in the reaction system. This can provide flexibility by allowing the excess catalyst space to be used for other purposes, such as a catalyst system for a subsequent hydroisomerization step. Still another advantage can be the ability to operate a reaction system at a lower temperature while still achieving a desired product sulfur level. From a practical standpoint, some combination of all of the above advantages can be selected, based in part on the nature of the feed to be processed, the nature of the reaction system, and the desired product, inter alia.

Conventionally, one or more of the above advantages can be obtained, but typically at the cost of using a full effective volume of the higher activity hydrodesulfurization catalyst system. Such higher activity catalyst systems typically have higher costs than catalyst systems that include the corresponding regenerated catalysts, or older generation catalysts with lower activities. In various embodiments, methods according to the invention allow the advantages of using a full effective volume of higher activity catalyst system to be captured while using a reduced cost catalyst system for at least a portion of the effective volume.

Based on the above, an improved process for desulfurizing a distillate feed to less than about 500 wppm, preferably less than about 100 wppm, can be provided. In an embodiment, a set of process conditions can be selected for desulfurizing a distillate feed. The conditions can include an effective volume of a catalyst system suitable for achieving a desired sulfur level in the product. However, instead of filling the entire effective volume with the suitable ("higher activity") catalyst system, from about 50% to about 90% of the volume is filled with that catalyst system. The remainder of the effective volume can be filled with a catalyst system having a desulfurization activity that is from about 10% to about 25% lower than the activity of the suitable ("higher activity") catalyst system. Examples of catalysts with lower activity can include regenerated catalysts. The catalysts can advantageously be loaded into the reaction system so that the lower activity catalyst system contacts the distillate feed first. The distillate feed can then be desulfurized to the desired sulfur level using the conditions originally selected for using the suitable ("higher activity") catalyst system in the full effective volume. In such an embodiment, even with a lower activity catalyst system being used in a portion of the effective volume, the resulting distillate product can still advantageously meet the desired sulfur specification. Additionally, the sulfur specification can advantageously be achieved at the same throughput as if the suitable ("higher activity") catalyst system occupied the full effective volume.

In some embodiments, the suitable "higher activity" catalyst system can include two or more catalysts. In such embodiments, some or all of at least one of the catalysts in the higher activity catalyst system can be replaced with another catalyst, so that a corresponding "lower activity" catalyst system can be formed. In a catalyst system, the two or more catalysts can be mixed together, or the catalysts can be in separate layers. In still other embodiments, the catalysts in a catalyst system can be distributed in any other convenient manner, such as multiple layers of varying composition.

Feedstock

In various embodiments, suitable feedstocks can include feedstocks boiling in the distillate range. One example of a suitable feed is a diesel boiling range feed having a boiling range from about 450° F. (about 232° C.) to about 800° F. (about 427° C.). Another example of a suitable feed is a diesel boiling range feed that includes a kerosene cut. Such a feed can have a boiling range from about 250° F. (about 121° C.) to about 800° F. (about 427° C.). Still another example of a suitable feed can be a heavier feed having a boiling range from about 550° F. (about 288° C.) to about 1100° F. (about 593° C.). In other embodiments, distillate feeds with other initial or end boiling points within the above ranges can be used. In an embodiment, the initial boiling point of the distillate range feed can be at least about 250° F. (about 121° C.), at least about 350° F. (about 177° C.), at least about 450° F. (about 232° C.), at least about 500° F. (about 260° C.), or at least about 550° F. (about 288° C.). Alternatively, the T5 boiling point (i.e., the temperature at which 5 wt % of the feed boils) can be at least about 250° F. (about 121° C.), at least about 350° F. (about 177° C.), at least about 450° F. (about 232° C.), at least about 500° F. (about 260° C.), or at least about 550° F. (about 288° C.). In another embodiment, the end boiling point of the distillate range feed can be about 1100° F. (about 593° C.) or less, about 1000° F. (about 538° C.) or less, about 900° F. (about 482° C.) or less, about 800° F. (about 427° C.) or less, or about 700° F. (about 371° C.) or less. Alternatively, the T95 boiling point (i.e., the temperature at which 95 wt % of the feed boils) can be about 1100° F. (about 593° C.) or less, about 1000° F. (about 538° C.) or less, about 900° F. (about 482° C.) or less, about 800° F. (about 427° C.) or less, or about 700° F. (about 371° C.) or less.

In an embodiment, the distillate boiling range feedstock can include at least a portion of a biocomponent feedstock. A biocomponent feedstock refers to a hydrocarbon feedstock derived from a biological raw material component, such as vegetable fats/oils, animal fats/oils, fish oils, pyrolysis oils, and algae fats/oils, as well as components of such materials. Note that for the purposes of this document, vegetable fats/oils refer generally to any plant based material, and include fat/oils derived from a source such as plants from the genus Jatropha. The vegetable, animal, fish, and algae fats/oils that can be used in the present invention can advantageously include any of those which comprise triglycerides and/or free fatty acids (FFA). The triglycerides and FFAs typically contain aliphatic hydrocarbon chains in their structure having from 8 to 36 carbons, preferably from 10 to 26 carbons, for example from 14 to 22 carbons. Other types of feed that are derived from biological raw material components include fatty acid esters, such as fatty acid alkyl esters (e.g., FAME and/or FAEE). Examples of biocomponent feedstocks include but are not limited to rapeseed (canola) oil, soybean oil, coconut oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, tallow oil, rice bran oil, and the like, and combinations thereof.

In one embodiment, the biocomponent feedstock can include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof. Major classes of lipids include, but are not necessarily limited to, fatty acids, glycerol-derived lipids (including fats, oils and phospholipids), sphingosine-derived lipids (including ceramides, cerebrosides, gangliosides, and sphingomyelins), steroids and their derivatives, terpenes and their derivatives, fat-soluble vitamins, certain aromatic compounds, and long-chain alcohols and waxes. In living organisms, lipids generally serve as the basis for cell membranes and as a form of fuel storage. Lipids can also be found conjugated with proteins or carbohydrates, such as in the form of lipoproteins and lipopolysaccharides.

Algae oils or lipids can be contained in algae in the form of membrane components, storage products, and metabolites. Certain algal strains, particularly microalgae such as diatoms and cyanobacteria, contain proportionally high levels of lipids. Algal sources for the algae oils can contain varying amounts, e.g., from 2 wt % to 40 wt % of lipids, based on total weight of the algal biomass itself. Algal sources for algae oils can include, but are not limited to, unicellular and multicellular algae. Examples of such algae can include a rhodophyte, chlorophyte, heterokontophyte, tribophyte, glaucophyte, chlorarachniophyte, euglenoid, haptophyte, cryptomonad, dinoflagellum, phytoplankton, and the like, and a combination thereof. In one embodiment, algae can be of the classes Chlorophyceae and/or Haptophyta. Specific species can include, but are not limited to, *Neochloris oleoabundans, Scenedesmus dimorphus, Euglena gracilis, Phaeodactylum tricornutum, Pleurochrysis carterae, Prymnesium parvum, Tetraselmis chui*, and *Chlamydomonas reinhardtii.*

Biocomponent based diesel boiling range feedstreams can typically have low nitrogen and sulfur content. For example, a biocomponent based feedstream can contain up to about 300 parts per million by weight (wppm) nitrogen (in the form of nitrogen-containing compounds). Instead of nitrogen and/or sulfur, the primary heteroatom component in biocomponent based feeds is typically oxygen (in the form of oxygen-containing compounds). Suitable biocomponent diesel boiling range feedstreams can include up to about 10-12 wt % oxygen. In preferred embodiments, the sulfur content of the biocomponent feedstream can advantageously be about 15 wppm or less, preferably about 10 wppm or less, although, in some embodiments, the biocomponent feedstream can be substantially free of sulfur (e.g., can contain no more than 50 wppm, preferably no more than 20 wppm, for example no more than 15 wppm, no more than 10 wppm, no more than 5 wppm, no more than 3 wppm, no more than 2 wppm, no more than 1 wppm, no more than 500 wppb, no more than 200 wppb, no more than 100 wppb, no more than 50 wppb, or completely no measurable sulfur).

In some embodiments, a biocomponent feedstream can be mixed with a mineral diesel boiling range feedstream for co-processing. In other embodiments, a diesel boiling range product from hydrotreatment of a biocomponent feedstock can be mixed with a mineral feed for further processing. In such embodiments, the mineral feedstream can have a boiling range from about 150° C. to about 400° C., for example from about 175° C. to about 350° C. Mineral feedstreams for blending with a biocomponent feedstream can have a nitrogen content from about 50 to about 6000 wppm nitrogen, for example from about 50 to about 2000 wppm, such as from about 75 to about 1000 wppm nitrogen. In an embodiment, feedstreams suitable for use herein can have a sulfur content from about 100 to about 40000 wppm sulfur, for example from about 200 to about 30000 wppm, such as from about 350 to about 25000 wppm. In some embodiments, the mineral stream for blending with the biocomponent stream can be a diesel boiling range stream. In other embodiments, the mineral stream can be a higher boiling stream, such as an atmospheric or vacuum gas oil. In still other embodiments, the mineral stream can be a lighter boiling stream, such as a heavy naphtha, a catalytically cracked feed or product (e.g., for/from FCC), and/or a virgin naphtha stream. Other examples of suitable mineral streams can include resid, cycle oils, and coker derived oils, as well as combinations of any of these and/or any of the other aforementioned streams.

In other embodiments, the distillate boiling range feedstock can be a mineral feedstock. Mineral feedstocks can have a content of nitrogen-containing compounds (also called nitrogen content, or abbreviated as nitrogen) from about 50 wppm to about 6000 wppm, for example from about 50 wppm to about 2000 wppm or from about 75 wppm to about 1000 wppm nitrogen. In an embodiment, feedstreams suitable for use herein can have a content of sulfur-containing compounds (also called sulfur content, or abbreviated as sulfur) of at least about 1000 wppm of sulfur, for example at least about 1500 wppm, or at least about 2000 wppm. Alternatively, the sulfur content can be about 20000 wppm sulfur or less, or about 15,000 wppm or less, or about 10,000 wppm or less. In biocomponent diesel boiling range feedstreams, instead of nitrogen and/or sulfur, the primary heteroatom component is typically oxygen. Suitable biocomponent diesel boiling range feedstreams can therefore include as much as about 10-12 wt % oxygen. In embodiments where at least a portion of the feed is based on a biocomponent feedstock, the amount of sulfur in the total feed can be at least about 1000 wppm, for example at least about 2000 wppm.

Examples of mineral feedstocks can include, but are not limited to, straight run (atmospheric) gas oils, vacuum gas oils, demetallized oils, coker distillates, cat cracker distillates, heavy naphthas (optionally but preferably at least partially denitrogenated and/or at least partially desulfurized), diesel boiling range distillate fraction (optionally but preferably at least partially denitrogenated and/or at least partially desulfurized), jet fuel boiling range distillate fraction (optionally but preferably at least partially denitrogenated and/or at least partially desulfurized), kerosene boiling range distillate fraction (optionally but preferably at least partially denitrogenated and/or at least partially desulfurized), and coal liquids. The mineral oil that can be included as/in the feedstock can comprise any one of these example streams or any combination thereof that would be suitable for hydrocracking with the biocomponent portion. Preferably, the feedstock does not contain any appreciable asphaltenes. In one embodiment, the mineral feedstock can be mixed with the biocomponent portion and then hydrotreated to form a hydrotreated material. In another embodiment, the mineral feedstock can be hydrotreated to reduce the nitrogen and/or sulfur content before being mixed with the biocomponent portion.

Catalyst Activity

Catalyst activity generally refers to the activity of a catalyst for catalyzing a given reaction or combination of reactions. In the various embodiments described herein, catalyst activity should be understood to refer to activity for a hydrodesulfurization reaction, even if other reactions may be occurring at the same time, e.g., hydrodenitrogenation, hydrodeoxygenation, hydrogenation of hydrocarbon unsaturations, dearomatization, and the like, and combinations thereof. Additionally, in the various embodiments described herein, the catalyst activity can be defined as a relative catalyst activity per volume. The densities of various hydrodesulfurization catalysts can have some variation, so using catalyst activity per volume can facilitate comparison between catalyst systems containing disparate types of catalysts.

When describing catalyst activity, relative activity values are often used as opposed to absolute activity values. The relative volume activity of a catalyst can be defined in several ways. For example, one method can be to select a set of (hydrodesulfurization) conditions and test two or more catalysts under the conditions. Such tests can provide a direct comparison of the activity per volume of the catalysts at the specified (hydrodesulfurization) conditions. Another option can be to develop a model for catalyst activity. The model can account for the conditions used in performing a (hydrodesulfurization) reaction, such as temperature, pressure, liquid hourly space velocity, ratio of treat gas volume to feed volume, and/or other selected conditions. The model can allow data from (hydrodesulfurization) reactions at different conditions to be correlated, so that activity comparisons can be made without having to test catalysts at identical conditions.

In the discussion below, relative catalyst activity is defined as $200*(k_a/k_b)$, where $k_a$ and $k_b$ are reaction rate constants for two catalysts. The reaction rate constants can be determined, for example, by fitting a kinetic expression to measured (hydrodesulfurization) reaction rates at a number of (two) different temperatures. The kinetic expression can typically include a reaction order, such as 1.5. In the discussion below, the measurements used for determining the reaction rate constants can be measurements, e.g., for reducing the heteroatom (sulfur) content of a distillate feed to 50 wppm or less. Thus, unless otherwise indicated, the relative volume activity values represent activity for reducing the sulfur content of a distillate feed to 50 wppm or less.

In embodiments involving a catalyst system containing two or more catalysts, a relative volume activity can first be determined for each of the catalysts in the catalyst system. The individual relative volume catalyst activities can then be used to form a weighted average, e.g., based on volume, to calculate an activity for the catalyst system.

Catalyst

In various embodiments, the catalysts used for desulfurization of the distillate feed can be catalysts including a Group VIB metal and/or a Group VIII metal on a support. Examples of Group VIB metals can include molybdenum, tungsten, and combinations thereof. Examples of Group VIII metals include non-noble Group VIII metals, such as cobalt, iron, nickel, and combinations thereof. In some alternative embodiments, other Group VIII metals such as platinum, palladium, and/or iridium can also/alternately be used. In a preferred embodiment, one or more catalysts in a catalyst system can be comprised of metals that include, or consist essentially of, cobalt and molybdenum. The support can be a zeolitic and/or amorphous bases. Additionally or alternately, the support can be any suitable refractory support material, including relatively high specific surface area metal oxides such as silica, alumina, silica-alumina, titania, zirconia, and combinations thereof. Commercially available examples of catalysts containing cobalt and molybdenum on a support include Ketjenfine® 757 (KF 757), available from Albemarle Corporation, and TK 576, available from Haldor Topsoe A/S. While one preferred embodiment includes a catalyst comprising a Group VIB metal and a Group VIII metal (e.g., in oxide form, or preferably after the oxide form has been sulfidized under appropriate sulfidization conditions), optionally on a support, the catalyst may additionally or alternately contain additional components, such as other transition metals (e.g., Group V metals such as niobium), rare earth metals, organic ligands (e.g., as added or as precursors left over from oxidation and/or sulfidization steps), phosphorus compounds, boron compounds, fluorine-containing compounds, silicon-containing compounds, promoters, binders, fillers, or like agents, or combinations thereof. The Groups referred to herein refer to Groups of the CAS Version as found in the Periodic Table of the Elements in Hawley's Condensed Chemical Dictionary, $13^{th}$ Edition. By way of illustration, suitable Group VIII/VIB catalysts are described, for example, in one or more of U.S. Pat. Nos. 6,156,695, 6,162,350, 6,299,760, 6,582,590, 6,712,955, 6,783,663, 6,863,803, 6,929,738, 7,229,548, 7,288,182, 7,410,924, and 7,544,632, U.S. Patent Application Publication Nos. 2005/0277545, 2006/0060502, 2007/0084754, and 2008/0132407, and International Publication Nos. WO 04/007646, WO 2007/084437, WO 2007/084438, WO 2007/084439, and WO 2007/084471, inter alia.

In an embodiment, one or more fresh (sulfided) hydrodesulfurization catalysts can be used as the "higher activity" catalyst system in a reaction system. For the "lower activity" catalyst system, one option is to use a regenerated catalyst of a similar type. After regeneration, a typical commercially available catalyst can have a reactivity from about 75% to about 90% of the corresponding fresh catalyst activity. In another embodiment, catalysts can generally be selected so that the "lower activity" catalyst has an activity from about 75% to about 90% of the activity of the "higher activity" catalyst.

In another embodiment, the "higher activity" catalyst system can comprise a mixture of two or more catalysts. In some such embodiments, the "lower activity" catalyst system can be a mixture of the same catalysts as the "higher activity" mixture, but with different proportions. Alternatively, one or more components of the "higher activity" mixture can be omitted from the "lower activity" mixture, possibly leading to the "lower activity" catalyst system being just a single catalyst. Still another option is to use one or more catalysts not present in the "higher activity" mixture.

In still another embodiment, the "higher activity" catalyst system can include multiple layers of catalysts and/or catalyst mixtures. The "lower activity" catalyst layer can then be formed by replacing a portion of at least one layer of the "higher activity" catalyst system. In such embodiments, the layers in the "higher activity" catalyst system can be viewed as residing in two volumes. In such embodiments, a downstream volume corresponds to layers and/or portions of layers that are the same in the "higher activity" and "lower activity" catalyst systems. In such embodiments, an upstream volume corresponds to the layers and/or portions of layers that differ between the "higher activity" and "lower activity" catalyst systems. In an embodiment, the "highest activity" catalyst present in the first volume in the "higher activity" catalyst system can also be present in the second volume of the "higher activity" catalyst system. In another embodiment, the highest activity catalyst present in the second volume in the "higher activity" catalyst system can also be present in the first volume.

Reaction Conditions

The reaction conditions for the hydrodesulfurization reaction can be conditions suitable for reducing the sulfur content of the feedstream to about 15 wppm or less, for example to about 10 ppm by weight or less, as the feedstream is exposed to the catalyst bed(s) in the hydrodesulfurization reaction zone. The hydrodesulfurization reaction conditions can include one or more of a liquid hourly space velocity (LHSV) of about 0.4 $hr^{-1}$ to about 2.0 $hr^{-1}$, a total pressure from about 250 psig (about 1.7 MPa) to about 1500 psig (about 10.3 MPa), a temperature from about 550° F. (about 288° C.) to about 750° F. (about 399° C.), and a hydrogen treat gas rate from about 200 scf/bbl (about 34 $Nm^3/m^3$) to about 5000 scf/bbl (about 840 $Nm^3/m^3$). Preferably, the reaction conditions include one or more of an LHSV of about 0.7 $hr^{-1}$ to about 1.2 $hr^{-1}$, a total pressure from about 350 psig (about 2.4 MPa) to about 800 psig (about 5.5 MPa), a hydrogen treat gas rate from about 400 scf/bbl (about 67 $Nm^3/m^3$) to about 1050 scf/b (about 180 $Nm^3/m^3$) of at least about 55 wt % hydrogen (e.g., with the remainder comprising one or more inert gases), and a temperature from about 625° F. (about 329° C.) to about 700° F. (about 371° C.).

In the various embodiments described herein, liquid hourly space velocity is defined as a volume of feed per volume of catalyst per unit time. It is noted that the space velocity is defined per volume of catalyst, as opposed to a definition based on a volume of a reactor in the reaction system used for a hydrodesulfurization reaction.

In some embodiments, reaction conditions for different reactions can be compared to determine if they are substantially similar. In such embodiments, two sets of reaction conditions can be considered substantially similar based on a comparison of at least pressure, temperature, ratio of treat gas volume to feed volume, and liquid hourly space velocity. Pressures can be considered substantially similar if the pressures, on an absolute scale, differ by less than about 10%. Temperatures can be considered substantially similar if the temperatures differ by about 5° C. or less. Ratios of treat gas volume to feed volume can be considered substantially similar if the ratios differ by less than about 15%. Note that for this comparison, the amount of treat gas volume should be used as opposed to the total gas volume. Thus, for a treat gas containing 80% hydrogen (e.g., and 20% inert gas), only the volume of the hydrogen should be considered. Liquid hourly space velocities can be considered substantially similar if the space velocities differ by less than about 10%.

In an embodiment, the reaction conditions can be selected to reduce the sulfur level of the distillate feed to about 400 wppm of sulfur or less. Preferably, the reaction conditions can be selected to reduce the sulfur level to about 100 wppm or less, for example about 50 wppm or less, about 30 wppm or less, about 20 wppm or less, about 15 wppm or less, or about 10 wppm or less.

Reaction Systems

FIG. 1 schematically shows a reactor 100 suitable for performing a hydrodesulfurization reaction. Reactor 100 includes a catalyst bed 105. The portion of catalyst bed 105 below the dashed line corresponds to a downstream volume 106 of catalyst, while the portion above the dotted line corresponds to an upstream volume 107 of catalyst. Thus, in the embodiment shown in FIG. 1, catalyst bed 105 corresponds to the total effective volume of catalyst needed for achieving a desired product sulfur level at the specified conditions in a single reactor. In the embodiment shown in FIG. 1, the upstream volume 107 corresponds to the portion of the catalyst system that differs between a "higher activity" and "lower activity" catalyst system.

Inputs to reactor 100 include a distillate feed 120 and a hydrogen feed 130. Distillate feed 120 can be a feed as described above. Hydrogen feed 130 provides hydrogen for the desulfurization reaction. Preferably, the hydrogen feed can contain at least about 60 wt % hydrogen, for example at least about 80 wt % hydrogen. As shown in the embodiment in FIG. 1, feed 120 entering the reactor 100 first encounters upstream volume 107 of catalyst bed 105, followed by downstream portion 106. After passing through the reactor, the desulfurized distillate product exits the reactor and can enter optional separator 140. Separator 140 can separate out a distillate product 144 from gaseous contaminants, such as $H_2S$, CO, $CO_2$, and/or $NH_3$, that may be produced during the hydrodesulfurization process. The desulfurized product can optionally undergo additional treatments, such as additional hydroprocessing steps.

One option for further processing can be to pass the distillate product to a hydroisomerization stage. The hydroisomerization stage can be used to further improve the cold-flow properties of the liquid phase product stream.

In the optional hydroisomerization stage, a liquid phase product stream can be exposed to one or more reaction zones that are operated at hydroisomerization conditions, optionally but preferably in the presence of hydroisomerization catalyst. Hydroisomerization catalysts can suitably include molecular sieves such as crystalline aluminosilicates (zeolites) or silico-aluminophosphates (SAPOs). These catalysts may also carry a metal hydrogenation component, preferably one or more Group VIII metals, especially Group VIII noble metals. Hydroisomerization/Dewaxing conditions can include one or more of temperatures from about 280° C. to about 380° C., pressures from about 300 psig (about 2.1 MPag) to about 3000 psig (about 21 MPag), LHSVs from about 0.1 $hr^{-1}$ to about 5.0 $hr^{-1}$, and treat gas rates from about 500 scf/bbl (about 84 $Nm^3/m^3$) to about 5000 scf/bbl (about 840 $Nm^3/m^3$).

In various embodiments, the molecular sieve used for catalytic hydroisomerization/dewaxing can comprise an aluminosilicate, e.g., having an MRE framework zeolite such as ZSM-48, which is a 10-membered ring molecular sieve having a 1-D channel structure. ZSM-48-type molecular sieves can perform dewaxing primarily by isomerizing molecules within the feed. Typical silica to alumina ratios for the aluminosilicate can be from about 250 to 1 or less, or from 200 to 1. Preferably, the silica to alumina ratio of the aluminosilicate can be less than about 110 to 1, for example less than about 110 to about 20 or from about 100 to about 40. To form a catalyst, the molecular sieve can be composited with a binder. Suitable binders can include, but are not limited to silica, alumina, silica-alumina, titania, zirconia, or a mixture thereof. Other suitable binders will be apparent to those of skill in the art.

Figure 2:
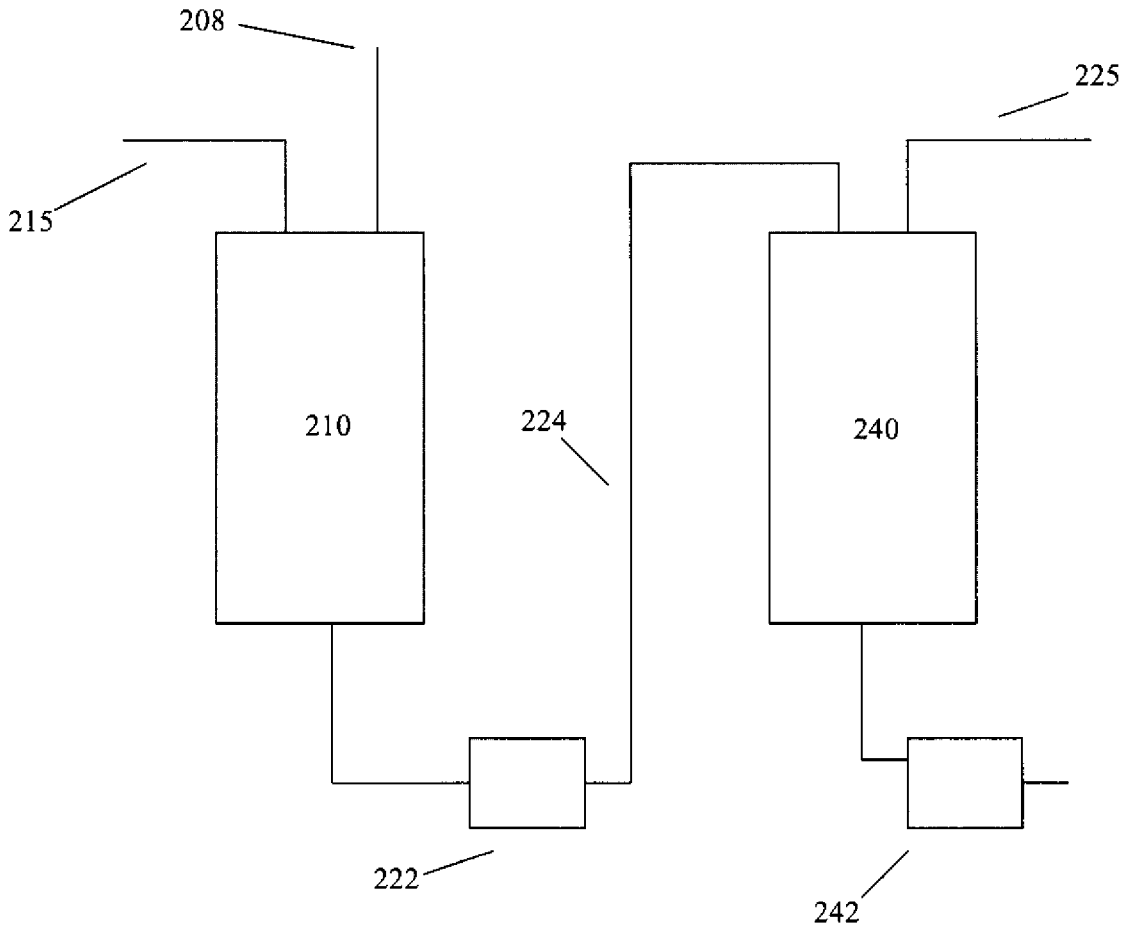
FIG. 2 schematically shows a reaction system for performing a process according to an embodiment of the invention.

One example of a reaction system suitable for carrying out the above processes is shown schematically in FIG. 2. In FIG. 2, a distillate feedstock 208 can be introduced into a hydrotreatment reactor 210. A hydrogen treat gas stream 215 can also be introduced into hydrotreatment reactor 210. The distillate feedstock is exposed to hydrotreating conditions in hydrotreatment reactor 210 in the presence of one or more catalyst beds that contain hydrotreating catalyst. The treated feedstock can flow into separator 222. Separator 222 can separate out distillate product 224 from gaseous contaminants, such as $H_2S$, CO, $CO_2$, and/or $NH_3$, that may be present after the hydrotreatment stage.

After passing through hydrotreatment reactor 210 and optionally separator 222, the distillate product can optionally enter second hydroprocessing reactor 240, along with second hydrogen treat gas stream 225. The optional second hydroprocessing reactor 240 can be a hydroisomerization reactor or another desired hydroprocessing reactor. Optionally, the treated feedstock can then pass through second separator 242 for separating gas and liquid products for various dispositions.

The liquid product from either the first or the second reactor can optionally undergo a variety of additional process steps. Optionally, the liquid stream can be passed through a liquid treatment step, such as by exposing the liquid to filtration, a caustic solution wash, a treatment with one or more chemical agents to remove sulfur and/or trace contaminants, or the like, or combinations thereof. Additionally or alternately, the liquid stream can be passed through a sulfur adsorption step, such as by exposing the liquid stream to metallic Ni, ZnO, or another adsorber of sulfur species.

Additionally or alternately, the present invention comprises the following embodiments.

Embodiment 1

A method for treating a distillate feed with a plurality of hydrodesulfurization catalysts, comprising: determining effective reaction conditions for processing a distillate feed with a first catalyst, including a temperature, a pressure, a ratio of hydrogen treat gas volume to feed volume, and a liquid hourly space velocity, the effective reaction conditions being suitable to form a distillate product having a target sulfur content of about 100 wppm of sulfur or less; providing a first volume of the first catalyst; providing a second volume of a second catalyst, the first volume and second volume comprising a combined volume, the second catalyst having a hydrodesulfurization activity from about 75% to about 90% of a hydrodesulfurization activity of the first catalyst, the first volume being from about 50% to about 90% of the combined volume; and processing the distillate feed under second reaction conditions that are substantially similar to at least the temperature, the pressure, the ratio of treat gas rate volume to feed volume, and the liquid hourly space velocity of the effective reaction conditions, the distillate feed contacting the second volume of catalyst prior to the first volume of catalyst, to produce a distillate product having a sulfur content within about 10 wppm of the target sulfur content.

Embodiment 2

A method for treating a distillate feed with a plurality of hydrodesulfurization catalysts, comprising: determining effective reaction conditions for processing a distillate feed with a first catalyst system, including a temperature, a pressure, a ratio of hydrogen treat gas volume to feed volume, and a liquid hourly space velocity, the effective reaction conditions being suitable to form a distillate product having a target sulfur content of about 100 wppm of sulfur or less, the first catalyst system including an upstream volume portion and a downstream volume portion, the downstream volume portion being about 50% to about 90% of a combined volume of the upstream volume and downstream volume; providing the downstream volume portion of the first catalyst system; providing a second catalyst system having a hydrodesulfurization activity from about 75% to about 90% of a hydrodesulfurization activity of the upstream volume portion of the first catalyst system; and processing the distillate feed in the reaction system under second reaction conditions that are substantially similar to at least the temperature, the pressure, the ratio of treat gas rate volume to feed volume, and the liquid hourly space velocity of the effective reaction conditions, the distillate feed contacting the second catalyst system prior to the first downstream volume portion of the first catalyst system, to produce a distillate product having a sulfur content within about 10 wppm of the target sulfur content.

Embodiment 3

A method for treating a distillate feed with a plurality of hydrodesulfurization catalysts, comprising: determining effective reaction conditions for processing a distillate feed with an effective volume of a first catalyst system, the effective reaction conditions including a temperature, a pressure, and a ratio of hydrogen treat gas volume to feed volume, and a liquid hourly space velocity, the effective reaction conditions being suitable to form a distillate product having a sulfur content of about 50 wppm of sulfur or less, the first catalyst system including an upstream volume portion and a downstream volume portion, the downstream volume portion of the first catalyst system having a volume about 50% to about 90% of a combined volume of the upstream volume and downstream volume; providing the downstream volume portion of the first catalyst system; providing a second catalyst system, the second catalyst system having a hydrodesulfurization activity from about 75% to about 90% of a hydrodesulfurization activity of the upstream volume portion of the first catalyst system, the second catalyst system having a volume about 105% or less of the upstream volume; and processing the distillate feed under second reaction conditions that are substantially similar to at least the temperature, the pressure, the ratio of treat gas rate volume to feed volume, and the liquid hourly space velocity of the effective reaction conditions, to produce a distillate product having a sulfur content of about 50 wppm or less.

Embodiment 4

The method of any of the previous embodiments, wherein the effective reaction conditions comprise an LHSV from about 0.4 $hr^{-1}$ to about 2.0 $hr^{-1}$, a total pressure from about 250 psig (about 1.7 MPag) to about 1500 psig (about 10.3 MPag), a temperature from about 550° F. (about 288° C.) to about 750° F. (about 399° C.), and a hydrogen treat gas rate from about 200 scf/bbl (about 34 $Nm^3/m^3$) to about 5000 scf/bbl (about 840 $Nm^3/m^3$).

Embodiment 5

The method of any of the previous embodiments, wherein the second catalyst or second catalyst system is a regenerated catalyst.

Embodiment 6

The method of any of the previous embodiments, wherein the first catalyst or first catalyst system comprises Co and Mo on a support material.

Embodiment 7

The method of embodiment 6, wherein the support material comprises silica, alumina, silica-alumina, titania, zirconia, or a combination thereof.

Embodiment 8

The method of any of the previous embodiments, wherein the second catalyst or second catalyst system comprises Co and Mo on a support material selected from silica, alumina, silica-alumina, titania, zirconia, or a combination thereof.

Embodiment 9

The method of any of the previous embodiments, further comprising hydroisomerizing the distillate product under effective hydroisomerization conditions.

Embodiment 10

The method of any of embodiments 2-9, wherein the downstream volume comprises at least about 65% of the combined volume.

Embodiment 11

The method of any of embodiments 2-10, wherein the activity of the second catalyst system is from about 80% to about 85% of the activity of the upstream volume portion of the first catalyst.

Embodiment 12

The method of any of the previous embodiments, wherein one or more of the following applies: the distillate feed is a mineral distillate feed, the distillate feed has a boiling point ranging from about 250° F. (about 121° C.) to about 800° F. (about 427° C.), and the distillate feed has a boiling point ranging from about 450° F. (about 232° C.) to about 1100° F. (about 593° C.).

Embodiment 13

The method of any of embodiments 2-12, wherein the upstream volume portion of the first catalyst system comprises at least one catalyst present in the downstream volume portion.

Embodiment 14

The method of any of embodiments 2-13, wherein At least one catalyst included in the upstream volume portion of the first catalyst system comprises the highest activity catalyst present in the downstream volume portion.

EXAMPLES

Example 1

Tables 1 and 2 each show portions of a catalyst system that correspond to an upstream volume. The catalyst systems can be referred to as Catalyst System 1 and Catalyst System 2. All of the catalysts shown in Tables 1 and 2 are supported catalysts that include both cobalt and molybdenum. Tables 1 and 2 include the relative volume activity for each catalyst, along with the volume percentage of that catalyst in the upstream volume. In this Example, Table 1 corresponds to the upstream volume for a "higher activity" catalyst system, while Table 2 corresponds to the upstream volume for a "lower activity" catalyst system. The catalysts were stacked in the order shown in the tables, with the most upstream catalyst listed first. The relative volume activity values for each catalyst were generated based on a model fit to prior hydrodesulfurization tests for each catalyst. It is noted that, in the experiments corresponding to this Example, the catalysts were actually located in two separate reactors, labeled here as Reactor 1 and Reactor 2. However, this configuration was used for convenience only and is believed to be equivalent to having all of the catalyst in successive beds within a single reactor.

TABLE 1

| Catalyst System 1 | Reactor 1 (kg*1000) | Reactor 2 (kg*1000) | % of Catalyst Volume | Relative Volume Activity (RVA) |
|---|---|---|---|---|
| Catalyst A | 1381 | | 14 | 149 |
| Catalyst B | 2343 | 6261 | 86 | 200 |
| Combined RVA | | | | 193 |

TABLE 2

| Catalyst System 2 | Reactor 1 (kg*1000) | Reactor 2 (kg*1000) | % of Catalyst Volume | Relative Volume Activity |
|---|---|---|---|---|
| Catalyst A | 122 | | 1 | 149 |
| Catalyst C | 949 | | 9 | 190 |
| Catalyst B | 2667 | | 27 | 200 |
| Catalyst D | | 6285 | 63 | 135 |
| Combined RVA | | | | 158 |

The combined RVA values in Tables 1 and 2 were calculated based on a weighted average of the individual relative volume activities, taking into consideration the volume of each catalyst. Based on the combined RVA values from Tables 1 and 2, using Catalyst System 1 as an upstream volume should lead to a catalyst system with higher activity than using the catalysts in Table 2. Based on the selection of Catalyst B as the baseline, with an RVA value of 200, the difference in Combined RVA values of 193 versus 158 corresponds to about an 18% difference in RVA between the two catalyst systems.

Figure 3A:
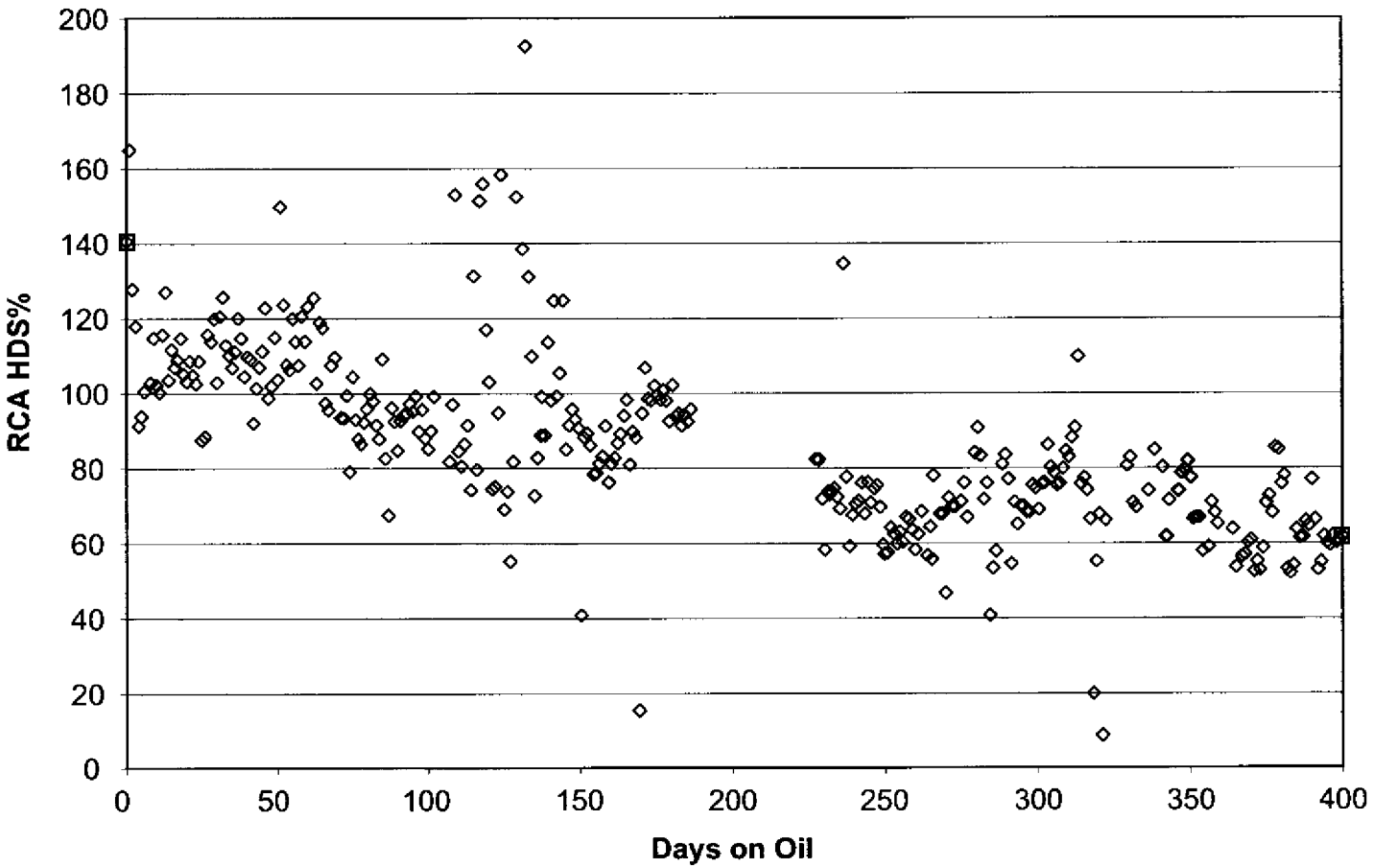
FIGS. 3A and 3B show relative activities for two examples of catalyst systems for reducing a sulfur content to a range from about 400 wppm to about 600 wppm of sulfur.
Figure 3B:
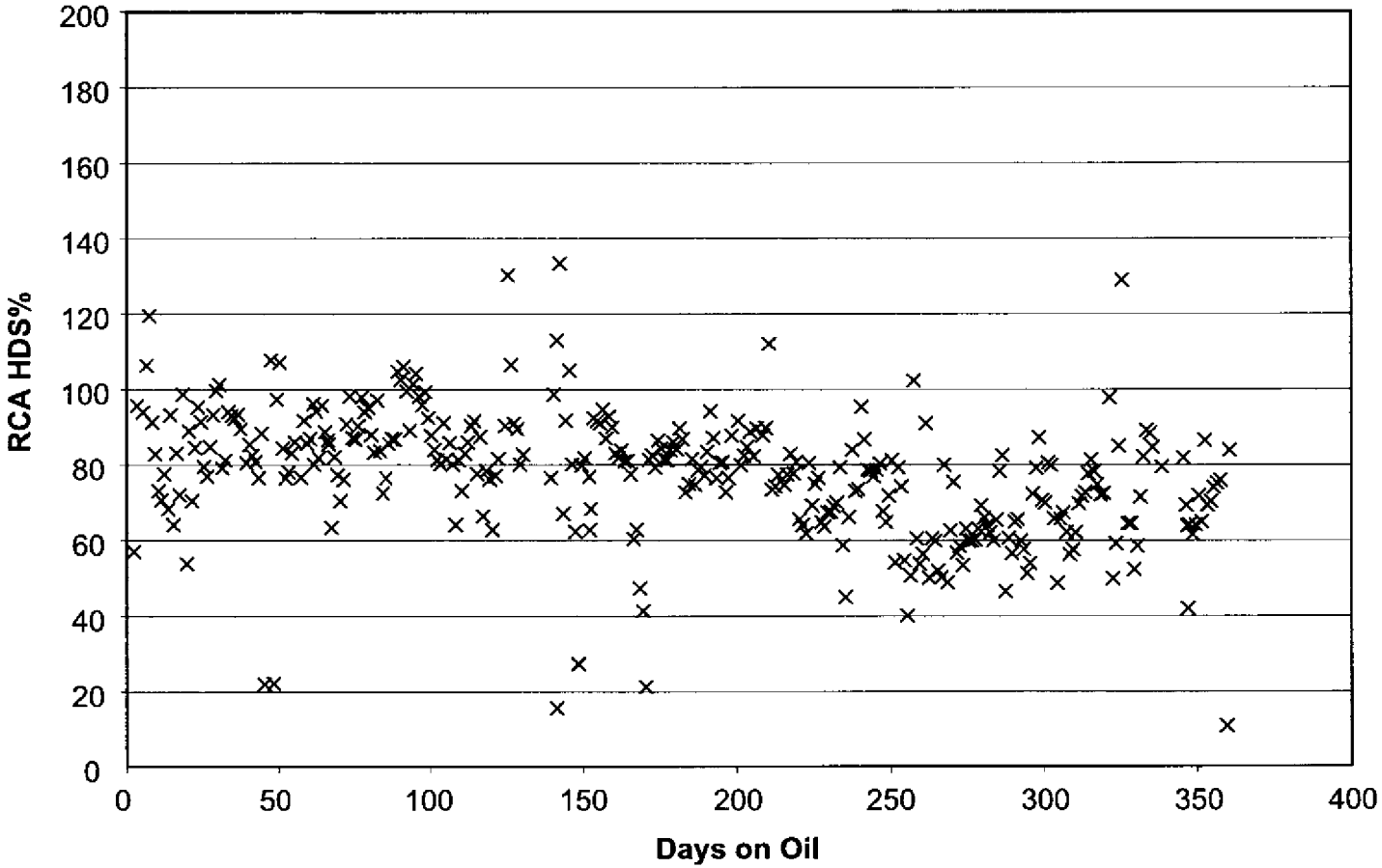
Figure 4:
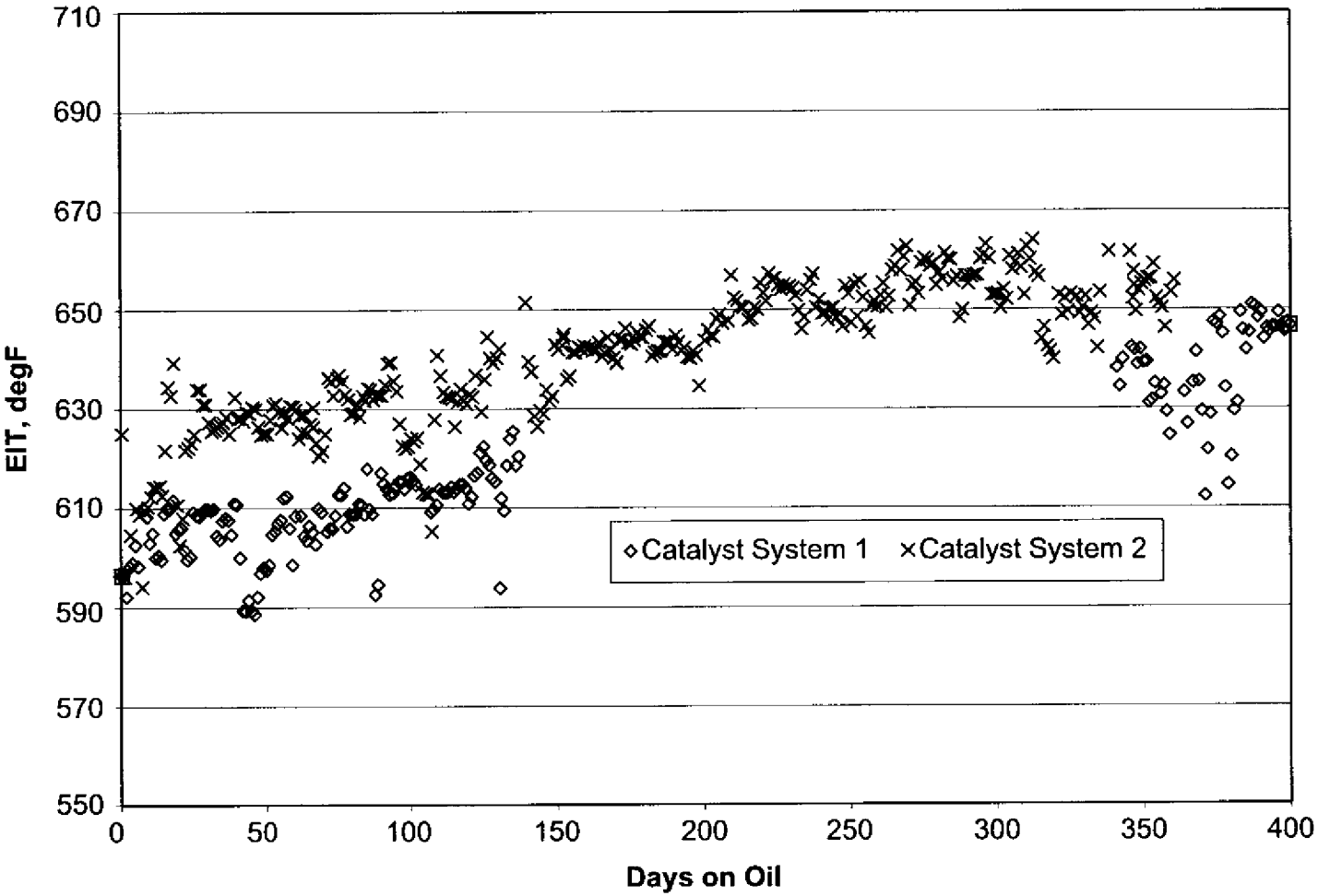
FIG. 4 shows reaction temperatures used during experiments using exemplary catalyst systems.
Figure 5:
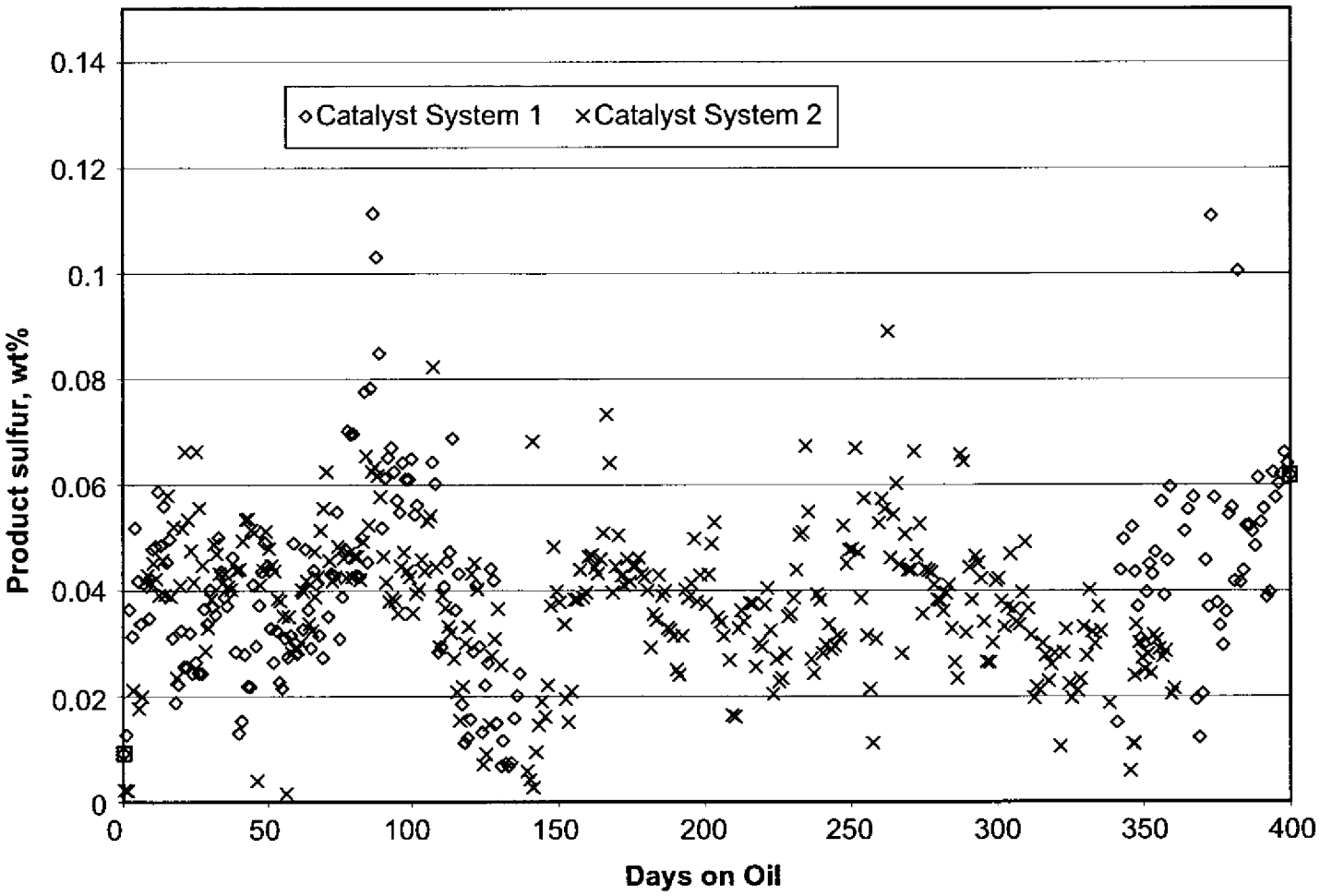
FIG. 5 shows product sulfur levels from experiments using exemplary catalyst systems.

FIGS. 3 to 5 show the results from the hydrodesulfurization processes that were performed using Catalyst Systems 1 and 2. Catalyst Systems 1 and 2 were used to process a distillate feed having an initial sulfur content of about 2 wt %, or about 20000 wppm. The target product sulfur level was from about 400 wppm to about 600 wppm. The results discussed below show a total run length of either 350 (Catalyst System 2) or 400 (Catalyst System 1) days on oil. The liquid hourly space velocity was between about 0.37 $hr^{-1}$ and about 0.39 $hr^{-1}$. The temperature ranged from about 590° F. (about 310° C.) to about 660° F. (about 349° C.) during the run, as shown in FIG. 4. The treat gas ratio of hydrogen to oil was about 1200 scf/bbl (about 200 $Nm^3/m^3$). The hydrogen partial pressure was between about 250 psia (about 1.7 MPaa) and about 275 psia (about 1.9 MPaa).

FIGS. 3A and 3B show the activity for Catalyst Systems 1 and 2 for achieving a final (product) sulfur content in the range from about 400 wppm to about 600 wppm, measured as if the catalyst systems were a single catalyst. Since the experiments shown in FIGS. 3A and 3B only reduce the sulfur content to about 400 wppm to about 600 wppm, the catalyst activities shown in FIGS. 3A and 3B are determined differently from the RVA values shown in Tables 1 and 2. To denote this difference, the activities shown in FIGS. 3A and 3B can be referred to herein as $RVA_{400}$ values.

In FIG. 3A, the $RVA_{400}$ of Catalyst System 1 is initially higher than the $RVA_{400}$ value shown in FIG. 3B for Catalyst System 2. However, by about 300 days on oil, the $RVA_{400}$ values for Catalyst Systems 1 and 2 are comparable, in spite of the lower RVA value for Catalyst System 2. Thus, after the initial processing period, FIGS. 3A and 3B show that a lower activity catalyst system can be used to achieve similar levels of sulfur reduction for product sulfur levels of 400 wppm sulfur or greater.

FIGS. 4 and 5 show the temperature and product sulfur levels for the same experiment shown in FIGS. 3A and 3B. It is noted that, in FIG. 4, the temperature used for Catalyst System 2 was higher than the temperature used for Catalyst System 1. However, after about 250 days on oil, the product sulfur level generated by Catalyst System 1 was about 500 wppm, as opposed to the about 400 wppm sulfur level for Catalyst System 2. In order to achieve about a 400 wppm sulfur level after about 250 days on oil, the temperature of Catalyst System 1 needed to be increased to about the temperature used for Catalyst System 2.

Prophetic Example 2

A catalyst system for reducing a product sulfur level to about 50 wppm or less can be formed by using either Catalyst System 1 or Catalyst System 2 as an upstream volume. Several choices are available for a suitable downstream volume. In this prophetic example, the downstream volume can include about 100% of Catalyst B. In other embodiments, the downstream volume can include at least about 50% Catalyst B, for example at least about 75% Catalyst B or at least about 90% Catalyst B, so long as the combined RVA for the downstream volume is greater than the combined RVA for the upstream volume.

In this prophetic example, about $20\times10^6$ kg of Catalyst B are used in the downstream volume. This corresponds to the downstream volume having about 66% of the catalyst volume, as both Catalyst System 1 and Catalyst System 2 include about $10\times10^6$ kg of catalyst. In other embodiments, the downstream volume can include at least about 50% of the catalyst volume, for example at least about 75% of the catalyst volume. In still other embodiments, the downstream volume can include about 90% or less of the catalyst volume.

Since Catalyst System 1 and Catalyst System 2 have similar abilities to reduce a sulfur content to about 400 wppm, either catalyst system can be used as an upstream volume in a catalyst system for producing a low sulfur distillate. Thus, the combined catalyst system of an upstream volume of Catalyst System 1 and a downstream volume of Catalyst B can be used under the reaction conditions for Catalyst System 1 in Example 1 to produce a distillate product with a sulfur level of 50 wppm or less. The combined catalyst system of an upstream volume of Catalyst System 2 and a downstream volume of Catalyst B can also be used to produce a distillate product with a similar sulfur level of 50 wppm or less.

The principles and modes of operation of this invention have been described above with reference to various exemplary and preferred embodiments. As understood by those of skill in the art, the overall invention, as defined by the claims, can encompasses other preferred embodiments not specifically enumerated herein.

What is claimed is:

1. A method for treating a distillate feed with a plurality of hydrodesulfurization catalysts, comprising:

determining effective reaction conditions for processing a distillate feed with a first catalyst, including an effective volume of the first catalyst, a temperature, a pressure, a ratio of hydrogen treat gas volume to feed volume, and a liquid hourly space velocity, the effective reaction conditions being suitable to form a distillate product having a target sulfur content of about 100 wppm of sulfur or less;

providing a first volume of the first catalyst;

providing a second volume of a second catalyst in place of a portion of the effective volume of the first catalyst, the second catalyst having a hydrodesulfurization activity from about 75% to about 90% of a hydrodesulfurization activity of the first catalyst, the first volume being from about 50% to about 90% of the effective volume; and processing the distillate feed under second reaction conditions that are substantially similar to at least the temperature, the pressure, the ratio of treat gas rate volume to feed volume, and the liquid hourly space velocity of the effective reaction conditions, the distillate feed contacting the second volume of catalyst prior to the first volume of catalyst, to produce a distillate product having a sulfur content within about 10 wppm of the target sulfur content.

2. The method of claim 1, wherein the effective reaction conditions comprise an LHSV from about 0.4 $hr^{-1}$ to about 2.0 $hr^{-1}$, a pressure from about 250 psig (about 1.7 MPag) to about 1500 psig (about 10.3 MPag), a temperature from about 550° F. (about 288° C.) to about 750° F. (about 399° C.), and a ratio of hydrogen treat gas volume to feed volume from about 200 scf/bbl (about 34 $Nm^3/m^3$) to about 5000 scf/bbl (about 840 $Nm^3/m^3$).

3. The method of claim 1, wherein the second catalyst is a regenerated catalyst.

4. The method of claim 1, wherein the first catalyst comprises Co and Mo on a support material.

5. The method of claim 4, wherein the support material comprises silica, alumina, silica-alumina, titania, or a combination thereof.

6. The method of claim 5, wherein the second catalyst comprises Co and Mo on a support material selected from silica, alumina, silica-alumina, titania, or a combination thereof.

7. The method of claim 1, further comprising hydroisomerizing the distillate product under effective hydroisomerization conditions.

8. A method for treating a distillate feed with a plurality of hydrodesulfurization catalysts, comprising:

determining effective reaction conditions for processing a distillate feed with a first catalyst system, including a temperature, a pressure, a ratio of hydrogen treat gas volume to feed volume, and a liquid hourly space velocity, the effective reaction conditions being suitable to form a distillate product having a target sulfur content of about 100 wppm of sulfur or less, the first catalyst system including an upstream volume portion and a downstream volume portion, the downstream volume portion being about 50% to about 90% of a combined volume of the upstream volume portion and the downstream volume portion;

providing the downstream volume portion of the first catalyst system;

providing a second catalyst system having a hydrodesulfurization activity from about 75% to about 90% of a hydrodesulfurization activity of the upstream volume portion of the first catalyst system in place of the upstream volume portion; and processing the distillate feed under second reaction conditions that are substantially similar to at least the temperature, the pressure, the ratio of treat gas rate volume to feed volume, and the liquid hourly space velocity of the effective reaction conditions, the distillate feed contacting the second catalyst system prior to the downstream volume portion of the first catalyst system, to produce a distillate product having a sulfur content within about 10 wppm of the target sulfur content.

9. The method of claim 8, wherein the downstream volume portion comprises at least about 65% of the combined volume.

10. The method of claim 8, wherein the activity of the second catalyst system is from about 80% to about 85% of the activity of the upstream volume portion of the first catalyst.

11. The method of claim 8, wherein the distillate feed is a mineral distillate feed.

12. The method of claim 8, wherein the distillate feed has a boiling point ranging from about 250° F. (about 121° C.) to about 800° F. (about 427° C.).

13. The method of claim 8, wherein the distillate feed has a boiling point ranging from about 450° F. (about 232° C.) to about 1100° F. (about 593° C.).

14. The method of claim 8, wherein the effective reaction conditions comprise an LHSV from about 0.4 $hr^{-1}$ to about 2.0 $hr^{-1}$, a pressure from about 250 psig (about 1.7 MPag) to about 1500 psig (about 10.3 MPag), a temperature from about 550° F. (about 288° C.) to about 750° F. (about 399° C.), and a ratio of hydrogen treat gas volume to feed volume from about 200 scf/bbl (about 34 $Nm^3/m^3$) to about 5000 scf/bbl (about 840 $Nm^3/m^3$).

15. The method of claim 8, wherein the upstream volume portion of the first catalyst system comprises at least one catalyst present in the downstream volume portion.

16. The method of claim 15, wherein the at least one catalyst included in the upstream volume portion of the first catalyst system comprises a highest activity catalyst present in the downstream volume portion.

* * * * *